US010273973B2

(12) United States Patent
Zheng et al.

(10) Patent No.: US 10,273,973 B2
(45) Date of Patent: Apr. 30, 2019

(54) CENTRIFUGAL COMPRESSOR HAVING AN ASYMMETRIC SELF-RECIRCULATING CASING TREATMENT

(75) Inventors: Xinqian Zheng, Beijing (CN); Yun Lin, Beijing (CN); Yangjun Zhang, Beijing (CN); Mingyang Yang, Beijing (CN); Takahiro Bamba, Tokyo (JP); Hideaki Tamaki, Tokyo (JP)

(73) Assignees: IHI CORPORATION, Tokyo (JP); TSINGHUA UNIVERSITY, Beijing (CN)

( * ) Notice: Subject to any disclaimer, the term of this patent is extended or adjusted under 35 U.S.C. 154(b) by 709 days.

(21) Appl. No.: 13/578,163

(22) PCT Filed: Feb. 3, 2011

(86) PCT No.: PCT/JP2011/052273

§ 371 (c)(1),
(2), (4) Date: Aug. 9, 2012

(87) PCT Pub. No.: WO2011/099418

PCT Pub. Date: Aug. 18, 2011

(65) Prior Publication Data

US 2012/0321440 A1 Dec. 20, 2012

(30) Foreign Application Priority Data

Feb. 9, 2010 (CN) ..... 2010 1 0110250
Feb. 9, 2010 (CN) ..... 2010 1 0110286

(51) Int. Cl.
*F04D 17/10* (2006.01)
*F04D 29/42* (2006.01)
*F04D 29/68* (2006.01)

(52) U.S. Cl.
CPC ..... *F04D 29/4213* (2013.01); *F04D 17/10* (2013.01); *F04D 29/685* (2013.01)

(58) Field of Classification Search
USPC ..... 415/58.4, 58.6, 203, 206, 58.3, 914; 416/58.3, 914
See application file for complete search history.

(56) References Cited

U.S. PATENT DOCUMENTS 4,930,979 A * 6/1990 Fisher et al. ..... 415/58.4
4,990,053 A * 2/1991 Rohne ..... 415/58.4
(Continued)

FOREIGN PATENT DOCUMENTS

JP 02-042199 2/1990
JP 3001902 B2 1/2000
(Continued)

OTHER PUBLICATIONS

International Search Report issued in related application PCT/JP2011/052269, completed Apr. 18, 2011 and dated Apr. 26, 2011.
(Continued)

*Primary Examiner* — Igor Kershteyn
*Assistant Examiner* — Christopher R Legendre
(74) *Attorney, Agent, or Firm* — Griffin and Sziple PC

(57) ABSTRACT

A centrifugal compressor includes an asymmetric self-recirculating casing treatment that includes, on an inner face of a casing 10, a suction ring groove 1, a ring guide channel 2 and a back-flow ring groove 3 to form a self-recirculating channel. An axial distance $S_r$ from an upstream end face of the suction ring groove 1 to an impeller full blade leading edge 4 or a width $b_r$ of the suction ring groove 1 is represented as $A\cdot\sin(\alpha+\theta_0)+A_0$ and is distributed in a sinusoidal shape in a circumferential direction, an initial phase angle $\theta_0$ is in a range of $0°\leq\theta_0\leq360°$, and a circumferential angle $\alpha$ of the casing 10 has a definition range of $\theta_0\leq\alpha\leq\theta_0+360°$. In the expression, A denotes amplitude of distribution of the axial distance $S_r$ or the width $b_r$, and $A_0$ denotes an average of the axial distance $S_r$ or the width $b_r$.

9 Claims, 12 Drawing Sheets

(56) References Cited

U.S. PATENT DOCUMENTS

| | | | | |
|---|---|---|---|---|
| 5,333,990 | A * | 8/1994 | Foerster et al. | 415/58.4 |
| 6,290,458 | B1 | 9/2001 | Irie et al. | |
| 7,229,243 | B2 | 6/2007 | Nikpour et al. | |
| 7,364,404 | B2 | 4/2008 | Guemmer | |
| 7,604,457 | B2 | 10/2009 | Xu | |
| 7,645,121 | B2 * | 1/2010 | Tudor | 415/220 |
| 9,816,522 | B2 * | 11/2017 | Zheng | F04D 29/685 |
| 2005/0008484 | A1 | 1/2005 | Bahram et al. | |
| 2008/0044273 | A1 * | 2/2008 | Khalid | 415/57.4 |
| 2008/0199306 | A1 | 8/2008 | Lebret | |
| 2009/0290974 | A1 * | 11/2009 | Bayere et al. | 415/58.5 |
| 2010/0014956 | A1 * | 1/2010 | Guemmer | 415/9 |
| 2015/0056062 | A1 * | 2/2015 | Tamaki | F04D 27/0207 415/58.4 |

FOREIGN PATENT DOCUMENTS

| | | | |
|---|---|---|---|
| JP | 2001-263296 | A | 9/2001 |
| JP | 2003-106299 | | 4/2003 |
| JP | 2004-332734 | A | 11/2004 |
| JP | 2007-127109 | A | 5/2007 |
| JP | 2007-224789 | A | 9/2007 |
| JP | 4100030 | B2 | 6/2008 |
| JP | 4107823 | B2 | 6/2008 |

OTHER PUBLICATIONS

International Search Report issued in related application PCT/JP2011/052272, completed Apr. 18, 2011 and dated Apr. 26, 2011.
International Search Report issued in corresponding application PCT/JP2011/052273, completed Apr. 18, 2011 and dated Apr. 26, 2011.
International Search Report issued in related application PCT/JP2011/052274, completed Apr. 18, 2011 and dated Apr. 26, 2011.
Office Action issued in co-pending related U.S. Appl. No. 13/578,137 dated Mar. 4, 2015.
Office Action issued in co-pending related U.S. Appl. No. 13/578,188 dated Feb. 25, 2015.
Office Action issued in co-pending related U.S. Appl. No. 13/578,101 dated Feb. 10, 2015.
Office Action issued in co-pending related U.S. Appl. No. 13/578,188 dated Nov. 3, 2015.
Final Office Action issued in co-pending related U.S. Appl. No. 13/578,188 dated Jun. 18, 2015.

* cited by examiner

CENTRIFUGAL COMPRESSOR HAVING AN ASYMMETRIC SELF-RECIRCULATING CASING TREATMENT

This is a National Phase Application in the United States of International Patent Application No. PCT/JP2011/052273 filed Feb. 3, 2011, which claims priority on Chinese Patent Application No. 201010110250.2 filed Feb. 9, 2010 and Chinese Patent Application No. 201010110286.0 filed Feb. 9, 2010. The entire disclosures of the above patent applications are hereby incorporated by reference.

TECHNICAL FIELD

The present invention relates to centrifugal compressors including an asymmetric self-recirculating casing treatment. The centrifugal compressors are used in turbomachinery for various purposes such as superchargers for vehicles and ships, industrial compressors and aeroengines.

BACKGROUND ART

Although turbo compressors using a centrifugal compressor have advantages such as having better efficiency, being lighter in weight and having more stable in operation than reciprocating compressors, their allowable operating range (i.e., the flow rate range of a centrifugal compressor) is limited.

At a small flow-rate operating point of a centrifugal compressor (i.e., when the flow rate of a compressor is small), instable phenomena such as considerable fluid separation at the internal flow field occur, thus causing stall and accordingly surge. As a result, rapid decrease in the efficiency and the pressure-ratio of the compressor is caused, the life of the compressor is shortened, and accordingly the compressor is damaged in a short time. To cope with this, various countermeasures are taken to suppress instable phenomena such as stall of a compressor for an extended stable operating range.

For instance, for an extended stable operating range, a casing treatment for centrifugal compressor is used. The following Patent Documents 1 to 5 disclose a casing treatment, for example.

As a casing treatment in Patent Literetures 1 to 5, at an inner face of a casing surrounding an impeller of a centrifugal compressor are formed (or defined) an annular inlet that is downstream of a leading edge of the impeller and an annular outlet that is upstream of the leading edge of the impeller. With this configuration, when the inflow rate into the centrifugal compressor is small, the fluid is returned from the annular inlet to the annular outlet via a casing interior, whereby the apparent inflow rate into the impeller is increased. As a result, instable phenomena such as stall can be suppressed to extend a stable operating range of a centrifugal compressor.

CITATION LIST

Patent Literature

PTL 1: JP 3001902
PTL 2: JP-A-2007-127109
PTL 3: JP 4100030
PTL 4: JP 4107823
PTL 5: U.S. Pat. No. 4,930,979

SUMMARY OF INVENTION

As described above, a casing treatment is currently considered as effective means to extend a stable operating range of a centrifugal compressor.

Conventionally a casing treatment is symmetrically configured with respect to a rotation axis of an impeller. Hereinafter, a casing treatment symmetrical with respect to the rotation axis is called a "symmetric casing treatment" and a casing treatment asymmetrical with respect to the rotation axis is called an "asymmetric casing treatment".

In the case of a centrifugal compressor including a symmetric casing treatment, a scroll channel of the casing is configured asymmetric with respect to a rotation axis of an impeller, and therefore the flow at the impeller outlet generates distortion in the circumferential direction due to the asymmetric scroll channel during a small flow rate outside a design range. Such distortion affects flow parameters on an upstream side, so that circumferential flow parameters of the impeller of the compressor or of the interior of a bladeless diffuser show asymmetric property.

Conventionally a symmetric casing treatment is configured without consideration given to an asymmetric property of a flow field at the interior of the compressor, and therefore the effect of extending a stable operating range from a casing treatment cannot be achieved for the entire circumferential direction. Accordingly in order to achieve an extending effect of an optimum stable operating range in the entire circumferential direction, an asymmetric self-recirculating casing treatment has to be used.

FIG. 1A is a half cross-sectional view of a centrifugal compressor including a self-recirculating casing treatment, and FIG. 1B is to explain the self-recirculating casing treatment.

In FIG. 1A, an impeller 13 includes an impeller full blade 11 and an impeller splitter blade 12. Z-Z represents the center of the rotation axis of the impeller 13. As illustrated in FIG. 1A and FIG. 1B, a self-recirculating casing treatment is typically configured including a suction ring groove 1, a ring guide channel 2 and a back-flow ring groove 3. The self-recirculating casing treatment has major configuration parameters of an axial direction distance (or axial distance) $S_r$ of the suction ring groove 1 with reference to an impeller full blade leading edge 4, a width $b_r$ of the suction ring groove, an axial distance $S_f$ of the back-flow ring groove 3 with reference to the impeller full blade leading edge 4, a width $b_f$ of the back-flow ring groove 3, a depth $h_b$ of the back-flow ring groove 3 and the width $b_b$ of the ring guide channel 2, for example.

It has been clarified by researches that the axial distance $S_r$ of the suction ring groove 1 with reference to the impeller full blade leading edge 4 and the width $b_r$ of the suction ring groove 1 directly determine a back-flow pressure difference and a back-flow rate, and such parameters greatly influence the expansion effect of an operating range. Therefore, correctly designed distribution of the axial distance $S_r$ of the suction ring groove 1 in the circumferential direction or the width $b_r$ becomes a key to extend the operating range of the centrifugal compressor using an asymmetric self-recirculating casing treatment.

The present invention is invented to fulfill the aforementioned demands. That is, it is an object of the present invention to provide a centrifugal compressor including an asymmetric self-recirculating casing treatment having optimized circumferential distribution of an axial distance $S_r$ of a suction ring groove with reference to an impeller full blade leading edge and a width $b_r$ of the suction ring groove, thereby enabling expansion of a stable operating range to a low-flow-rate side while keeping the efficiency.

A centrifugal compressor of the present invention includes an asymmetric self-recirculating casing treatment that includes, on an inner face of a casing, a suction ring groove (1), a ring guide channel (2) and a back-flow ring groove (3) to form a self-recirculating channel. An axial distance $S_r$ from an upstream end face of the suction ring groove to an impeller full blade leading edge (4) or a width $b_r$ of the suction ring groove is represented as $A\cdot\sin(\alpha+\theta_0)+A_0$ and is distributed in a sinusoidal shape in a circumferential direction. An initial phase angle $\theta_0$ is in a range of $0°\leq\theta_0\leq360°$. A circumferential angle $\alpha$ of the casing has a definition range of $\theta_0\leq\alpha\leq\theta_{0+}360°$. In the expression, A denotes amplitude of distribution of the axial distance $S_r$ or the width $b_r$, and $A_0$ denotes an average of the axial distance $S_r$ or the width $b_r$.

In one embodiment of the present invention, a ratio between the average $A_0$ of the axial distance $S_r$ of the suction ring groove and an impeller diameter D may be in a range of $0.05\leq|A_0/D|<0.2$, and a ratio between the amplitude A of the distribution of the axial distance $S_r$ and the average $A_0$ may be in a range of $0.1<|A/A_0|<0.35$.

In another embodiment of the present invention, a ratio between the average $A_0$ of the width $b_r$ of the suction ring groove and an impeller diameter D may be in a range of $0.01\leq|A_0/D|<0.1$, and a ratio between the amplitude A of the distribution of the width $b_r$ and the average $A_0$ may be in a range of $0.1<|A/A_0|<0.35$.

The casing may include a shell (5) and a core (6), and the suction ring groove (1) may be provided on a wall face of the core (6), and an inner wall face of the shell and an outer wall face of the core may define the ring guide channel (2) and the back-flow ring groove (3).

Advantageous Effects of Invention

The below described examples show that, as compared with conventional techniques, the present invention using an asymmetric self-recirculating casing treatment including a suction ring groove having an axial distance or a width distributed in a sinusoidal shape can extend a stable operating range of a centrifugal compressor greatly than that of a symmetric self-recirculating casing treatment, while substantially keeping the efficiency.

DESCRIPTION OF EMBODIMENTS

Figure 1A:
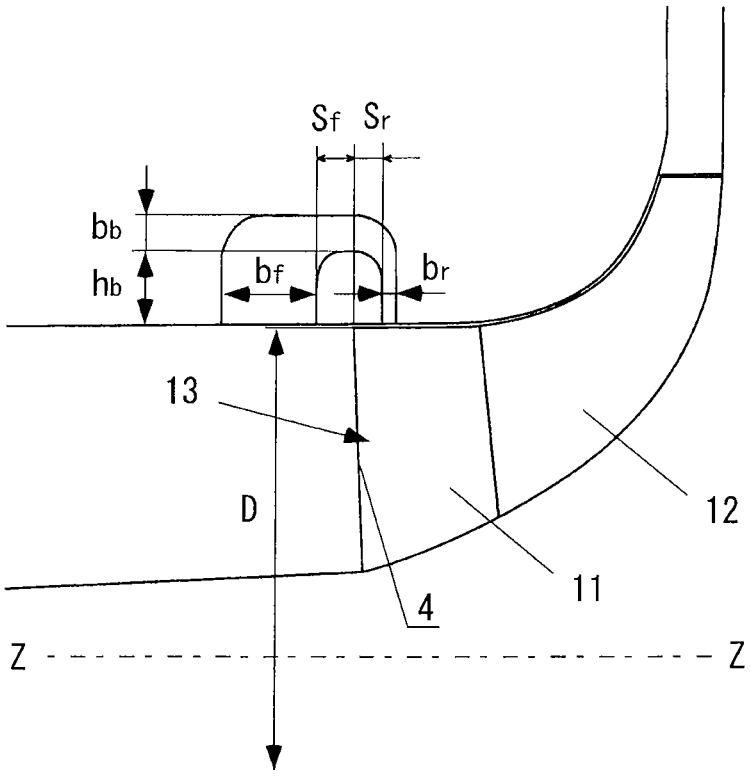
FIG. 1A is a half cross-sectional view of a centrifugal compressor including a self-recirculating casing treatment.

The following describes modes for carrying out the invention, with reference to the drawings. In the following, same reference numerals will be assigned to common elements in the drawings to omit their duplicated descriptions.

Embodiment 1

Figure 2A:
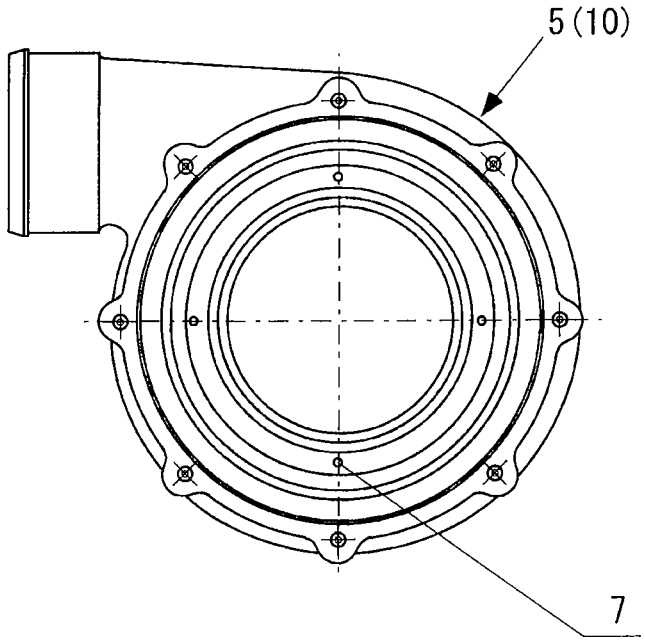
FIG. 2A is a schematic front view of a shell of a casing.
Figure 2B:
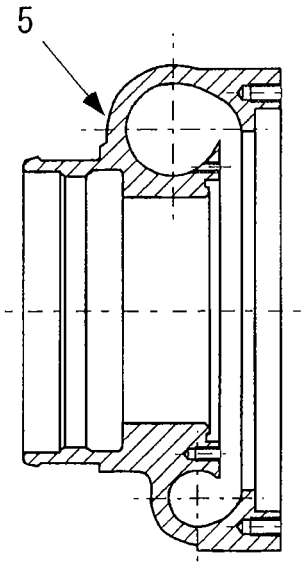
FIG. 2B is a schematic cross-sectional view of the shell of the casing.
Figure 3:
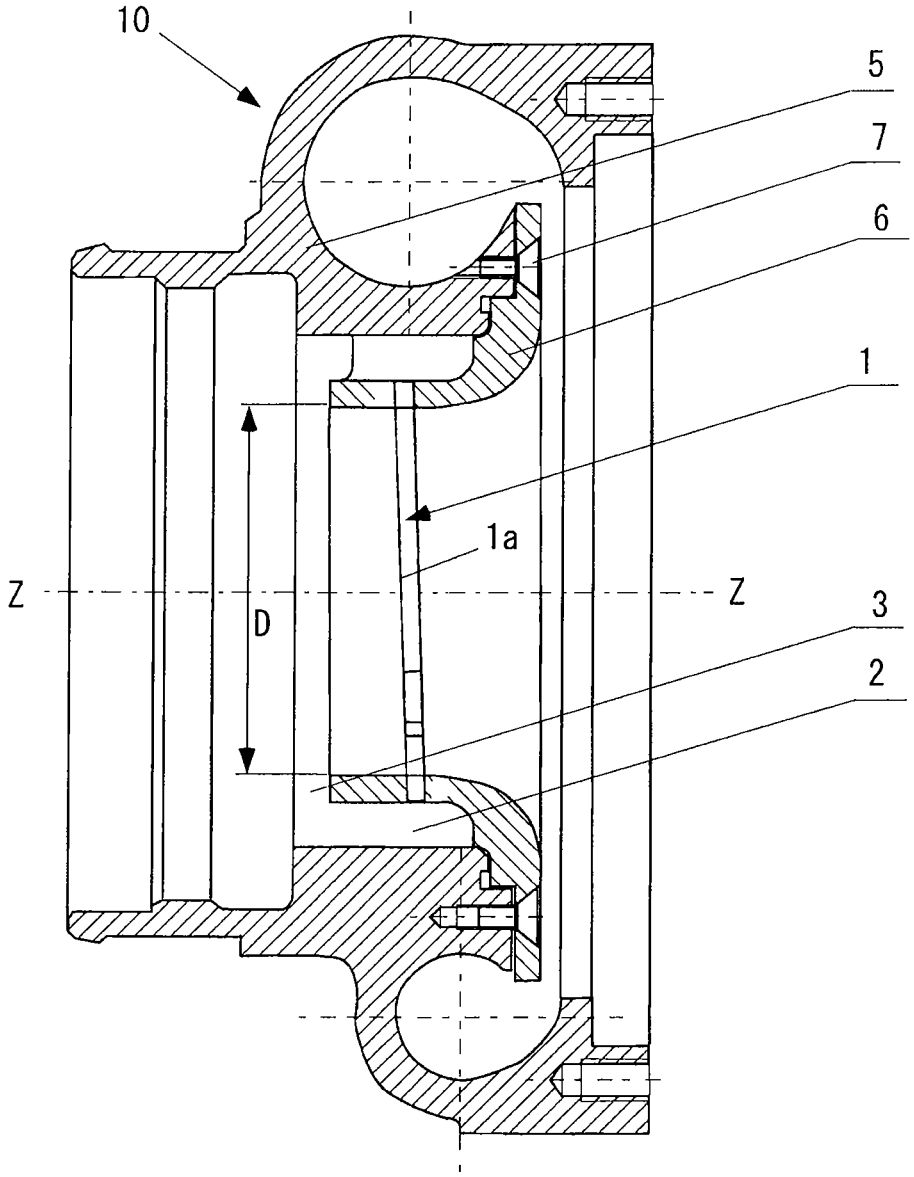
FIG. 3 is a schematic view of the casing of the compressor.
Figure 4:
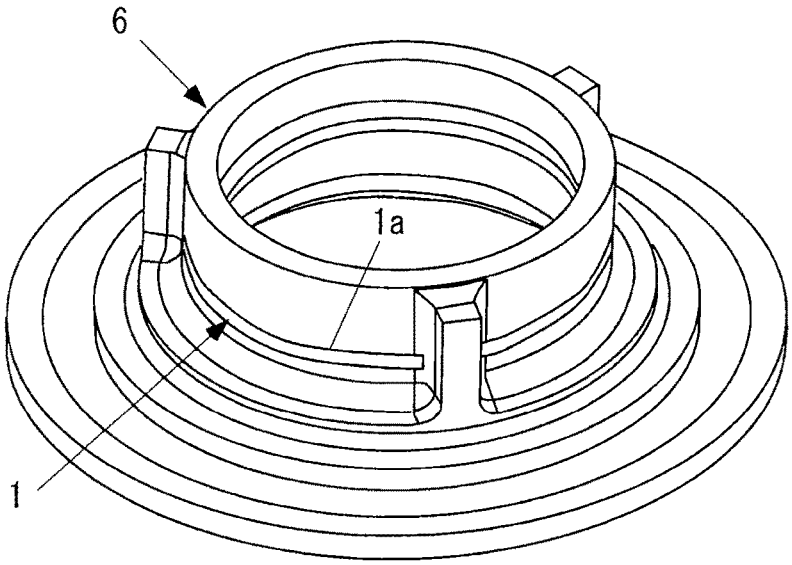
FIG. 4 is a schematic view of the configuration of a core of the casing.
Figure 5:
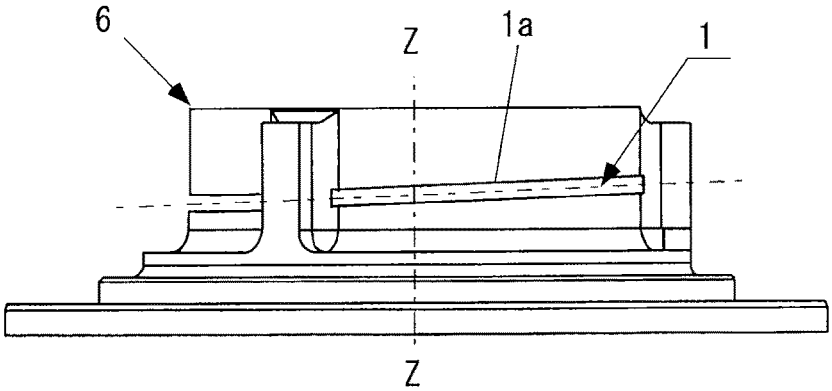
FIG. 5 is a schematic view of a suction ring groove in the core.

FIG. 2A, FIG. 2B and FIGS. 3 to 5 schematically illustrate Embodiment 1 of the present invention. FIG. 2A is a schematic front view of a shell 5 of a casing, FIG. 2B is a schematic half cross-sectional view thereof, FIG. 3 is a schematic view of the casing, FIG. 4 is a schematic view of the configuration of a core 6 of the casing, and FIG. 5 is a schematic view of a suction ring groove in the core.

Figure 1B:
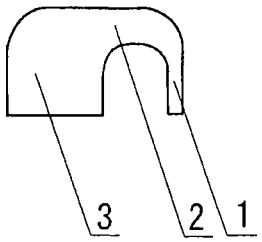
FIG. 1B is to explain the self-recirculating casing treatment.

As illustrated in FIG. 1, the centrifugal compressor of the present invention includes an asymmetric self-recirculating casing treatment that includes, on an inner face of a casing, a suction ring groove 1, a ring guide channel 2 and a back-flow ring groove 3, thus forming a self-recirculating channel.

The self-recirculating channel means a back-flow channel including the suction ring groove 1, the ring guide channel 2 and the back-flow ring groove 3 so as to return the fluid from a position downstream of an impeller full-blade leading edge to a position upstream of the impeller full-blade leading edge.

In the centrifugal compressor of Embodiment 1, as illustrated in FIG. 3, a casing 10 includes the shell 5 and the core 6, where the suction ring groove 1 is provided on a wall face of the core 6, and the inner wall face of the shell 5 and the outer wall face of the core 6 define the ring guide channel 2 and the back-flow ring groove 3.

In the asymmetric self-recirculating casing treatment of Embodiment 1, the axial distance of the suction ring groove 1, i.e., the axial distance $S_r$ from an upstream end face 1*a* of the suction ring groove 1 to the impeller full blade leading edge 4 is distributed in a sinusoidal shape in the circumferential direction.

As illustrated in FIG. 3, in Embodiment 1, the axial distance $S_r$ is represented by Expression (1):

$$S_r=A\cdot\sin(\alpha+\theta_0)+A_0 \quad (1)$$

Further, a ratio between an average $A_0$ of the axial distance $S_r$ of the suction ring groove 1 and an impeller diameter D is in the range of $0.05 \leq |A_0/D| < 0.2$, and a ratio between amplitude A of the distribution of the axial distance $S_r$ and the average $A_0$ of the axial distance $S_r$ of the suction ring groove 1 is in the range of $0.1 < |A/A_0| < 0.35$.

Geometric proof makes it clear that the axial distance of the suction ring groove 1 following the sinusoidal distribution in the circumferential direction as designed is included on a plane of a circumferential cylindrical column face of the core 6, which is illustrated with alternate long and short dash lines in FIG. 5.

This characteristic facilitates the processing and adjustment of the suction ring groove 1 designed. That is, the amplitude A of the axial distance $S_r$ distribution can be changed by changing the gradient of a line around the rotation axis. Further, vertically parallel movement of the line can change the ratio between the average $A_0$ of the axial distance $S_r$ of the suction ring groove 1 and the impeller diameter D and the ratio between amplitude A of the distribution of the axial distance $S_r$ and the average $A_0$ of the axial distance $S_r$ of the suction ring groove 1.

In FIG. 2A, FIG. 2B and FIG. 3, the shell 5 of the casing is fixed, and the core 6 is rotated around the rotation axis center Z-Z of the impeller 13 (see FIG. 1) so as to change the opposed position of these members during assembly, whereby the sinusoidal distribution of the axial distance $S_r$ of the suction ring groove 1 corresponding to different initial phase angles $\theta_0$ can be obtained.

That is, the shell 5 and the core 6 of the casing 10 are jointed by screws 7. At the shell 5 of the casing 10 are uniformly disposed n pieces (in this example, four) of screw holes in the circumferential direction, so that the distribution curves corresponding to different n pieces of initial phase angles $\theta_0$ are obtained. Performance test of the compressor is performed, whereby an optimum initial phase angle $\theta_0$ may be decided from the different n pieces of initial phase angles $\theta_0$.

Figure 6:
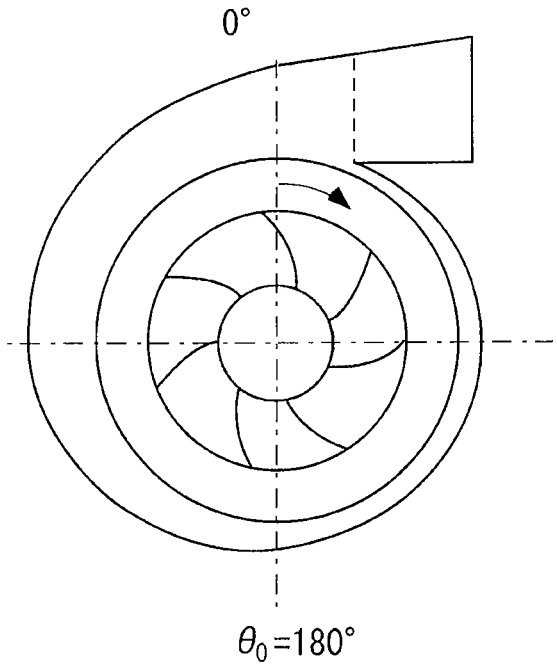
FIG. 6 schematically illustrates a position of an initial phase angle $\theta_0$ in one example.
Figure 7:
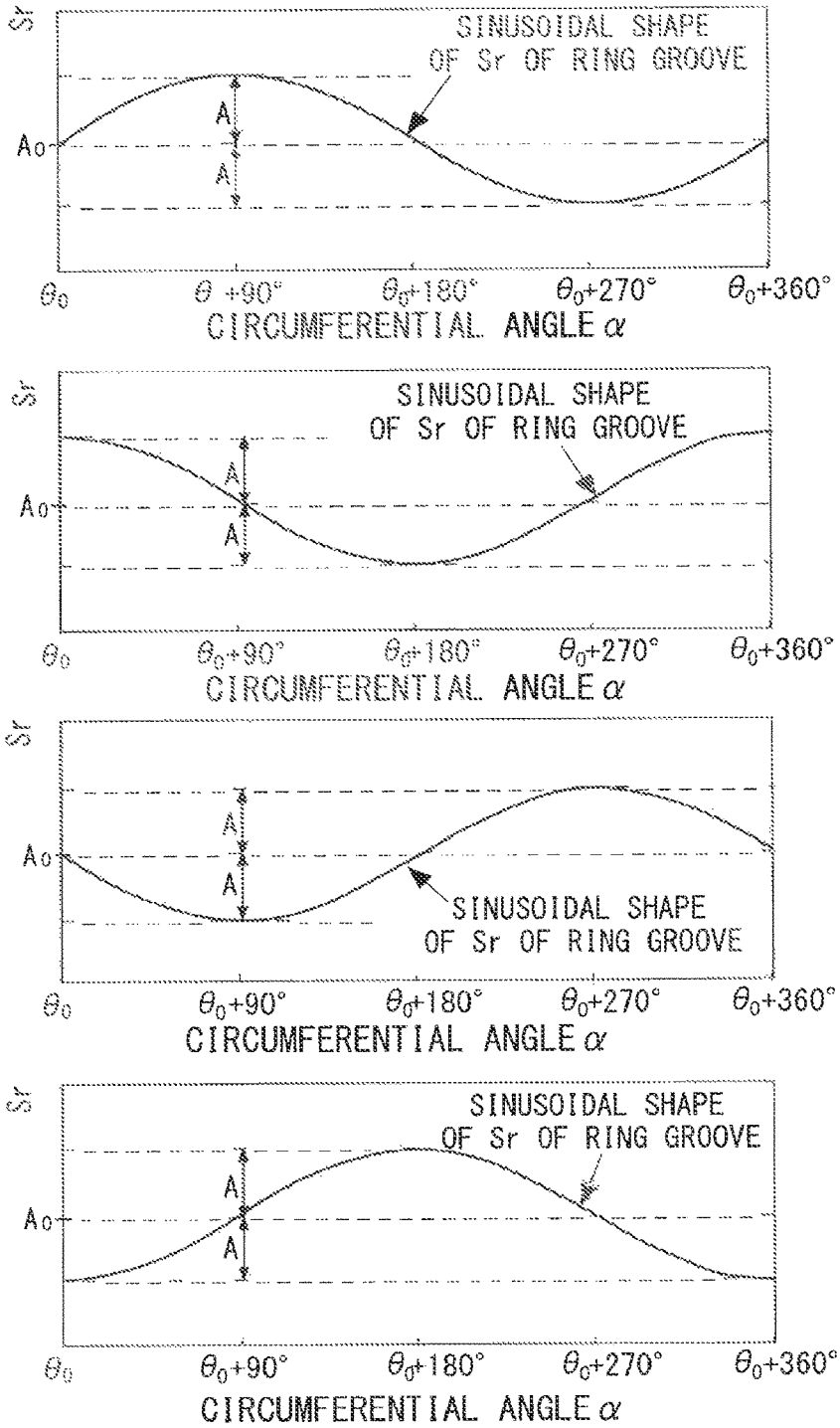
FIG. 7 schematically illustrates the distribution of the axial distance $S_r$ values of the suction ring groove in the circumferential direction corresponding to different initial phase angles $\theta_0$.

FIG. 6 schematically illustrates a position of an initial phase angle $\theta_0$ in one example. FIG. 7 schematically illustrates the distribution of axial distance $S_r$ values of the suction ring groove in the circumferential direction corresponding to different initial phase angles $\theta_0$.

In FIG. 2A and FIG. 2B, since four screw holes in total are provided at the shell 5 of the casing 10, different four types of sinusoidal distributions of the axial distance $S_r$ of the suction ring groove are obtained as illustrated in FIG. 7.

In FIG. 7, solid lines represent a sinusoidal distribution of the axial distance $S_r$ of the suction ring groove 1 in the circumferential direction, which can be represented variously by differently selecting the initial phase angle $\theta_0$ in the circumferential direction. Among them, $\theta_0$ represents an initial phase angle, and the casing 10 is the full circle of $0° \leq \theta_0 \leq 360°$. In the drawing, the circumferential angle $\alpha$ of the casing has a definition range of $\theta_0 \leq \alpha \leq \theta_{0+} \leq 360°$.

In the operation of the centrifugal compressor of the present invention, at a low flow-rate mode, the gas in the channel of the self-recirculating casing treatment flows into through the suction ring groove 1 and flows outside via the ring guide channel 2 and the back-flow ring groove 3.

More specifically, the centrifugal compressor operates based on the principle that the suction ring groove 1 of the self-recirculating casing treatment sucks the gas at an impeller blade tip area, and the gas flows through the ring guide channel 2 and the back-flow ring groove 3 discharges the gas.

As the back-flow ring groove 3 discharges the gas, (1) the gas suction effect of the impeller blade tip area at the axial distance $S_r$ of the suction ring groove 1 causes leakage vortex at a clearance of the impeller blade tip to be sucked to the suction ring groove 1, thus interrupting a leakage flowing channel, (2) a back-flow is discharged to the compressor inlet, and the communication of the flow in the back-flow ring groove 3 realizes the uniform flow at the compressor inlet and removes shock waves in the channel, and (3) while the back-flow increases the inlet flow rate and decreases a positive angle of attack at the impeller blade inlet, the suction effect by the suction ring groove 1 decreases the back pressure of the compressor outlet and decreases the adverse pressure gradient, thus effectively suppressing the separation of boundary layers on the impeller blade surface.

For a better back-flow effect at a corresponding position in the circumferential direction, the axial distance $S_r$ of the suction ring groove 1 is distributed in a sinusoidal shape in the circumferential direction, whereby the effect of the back-flow can be more effectively used to extend a stable operating range of the compressor.

At an operational mode close to a blockage, the gas in the channel of the self-recirculating casing treatment flows through the back-flow ring groove 3 and the ring guide channel 2 and is discharged from the suction ring groove 1. The back-flow ring groove 3 enables communication of the flow at the inlet in the circumferential direction to increase the uniformity of the flow at the compressor inlet and weaken shock waves at the inlet, and the discharged flow of the suction ring groove 1 strengthens the circulation ability, thus extending blockage boundary. However, because of the shortage of suction power at an operational mode close to a blockage, expansion for the blockage boundary of the casing treatment is not so remarkable as the expansion for stall boundary.

Example 1

The following describes an example to extend a stable operation range by using an asymmetric self-recirculating casing treatment for a centrifugal compressor having an axial distance $S_r$ in a sinusoidal distribution in a centrifugal compressor of a certain size.

$S_r$ of the asymmetric casing treatment of the centrifugal compressor is distributed as $S_r = \sin(\alpha + 180°) + 4$. The initial phase angle $\theta_0$ is at the position of $\theta_0 = 180°$ in FIG. 6.

Figure 8:
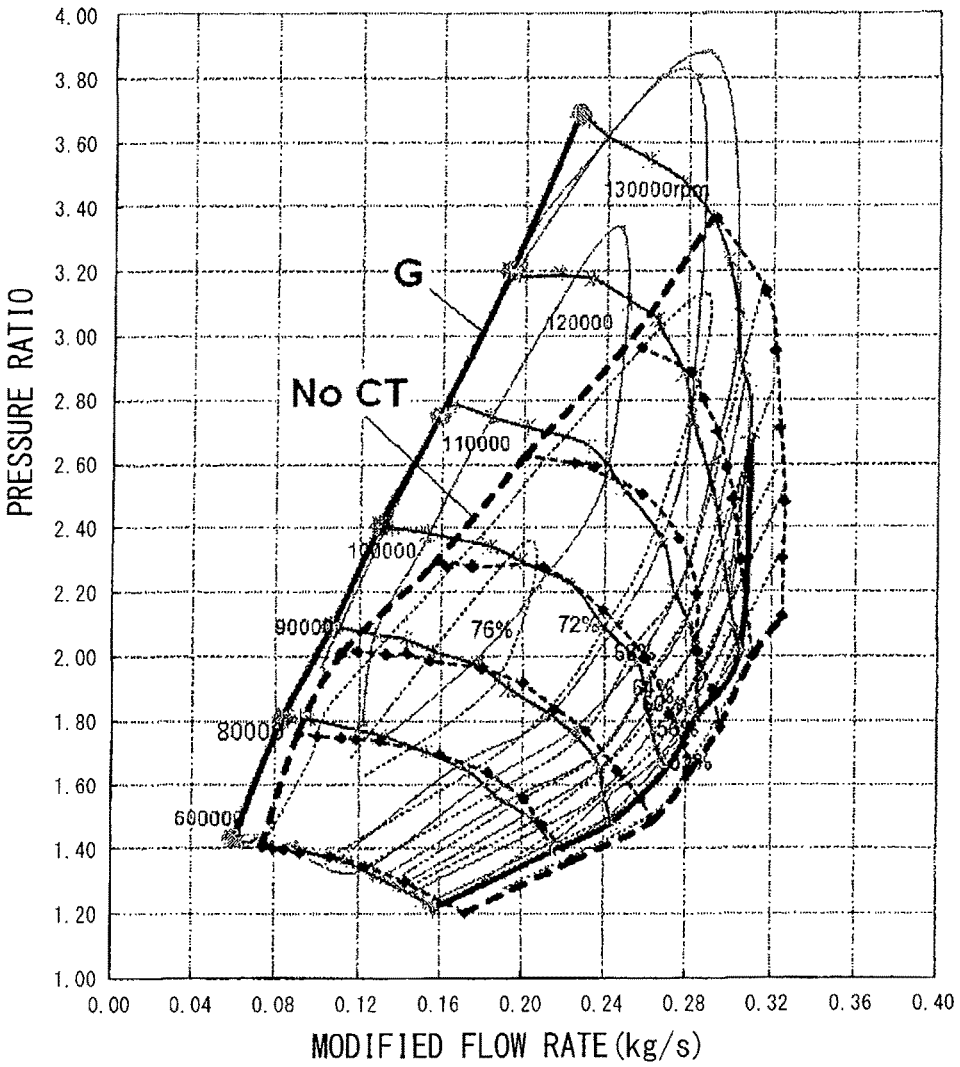
FIG. 8 illustrates performance comparison between an asymmetric self-recirculating casing treatment having an axial distance of a groove in a sinusoidal distribution and without a casing treatment

FIG. 8 illustrates performance comparison between an asymmetric self-recirculating casing treatment having an axial distance $S_r$ of a groove in a sinusoidal distribution and without a casing treatment. In the drawing, the sign "G" represents a performance map when the centrifugal compressor of Example 1 is used, and the sign "No CT" represents a MAP of a centrifugal compressor without a casing treatment.

Figure 9:
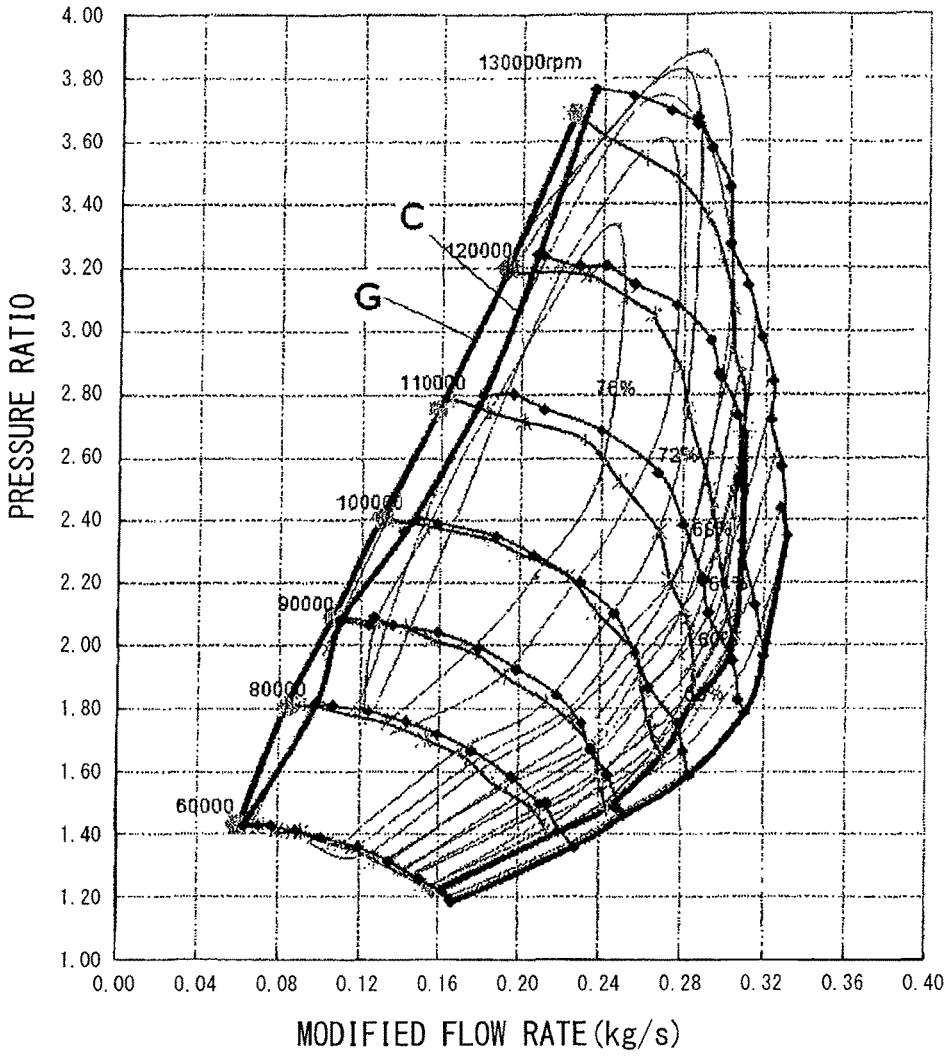
FIG. 9 illustrates performance comparison between an asymmetric self-recirculating casing treatment having an axial distance of a groove in a sinusoidal distribution and a symmetric self-recirculating casing treatment having a constant axial distance of a groove irrespective of a position in the circumferential direction.

FIG. 9 illustrates performance comparison between an asymmetric self-recirculating casing treatment having an axial distance $S_r$ of a groove in a sinusoidal distribution and a symmetric self-recirculating casing treatment having a constant axial distance of a groove irrespective of a position in the circumferential direction. In the drawing, the sign "G" represents a performance MAP when the centrifugal compressor of Example 1 is used, and the sign "C" represents a MAP of a centrifugal compressor when the symmetric self-recirculating casing treatment having a constant axial distance of a groove irrespective of a position in the circumferential direction is used.

The performance comparison between FIG. 8 and FIG. 9 shows that the asymmetric self-recirculating casing treatment having an axial distance $S_r$ of a groove in a sinusoidal distribution in Example 1 can extend a stable operating range of the compressor to a low flow-rate side while basically keeping the efficiency as compared with the cases of without a casing treatment and the symmetric self-recirculating casing treatment.

Embodiment 2

Figure 10:
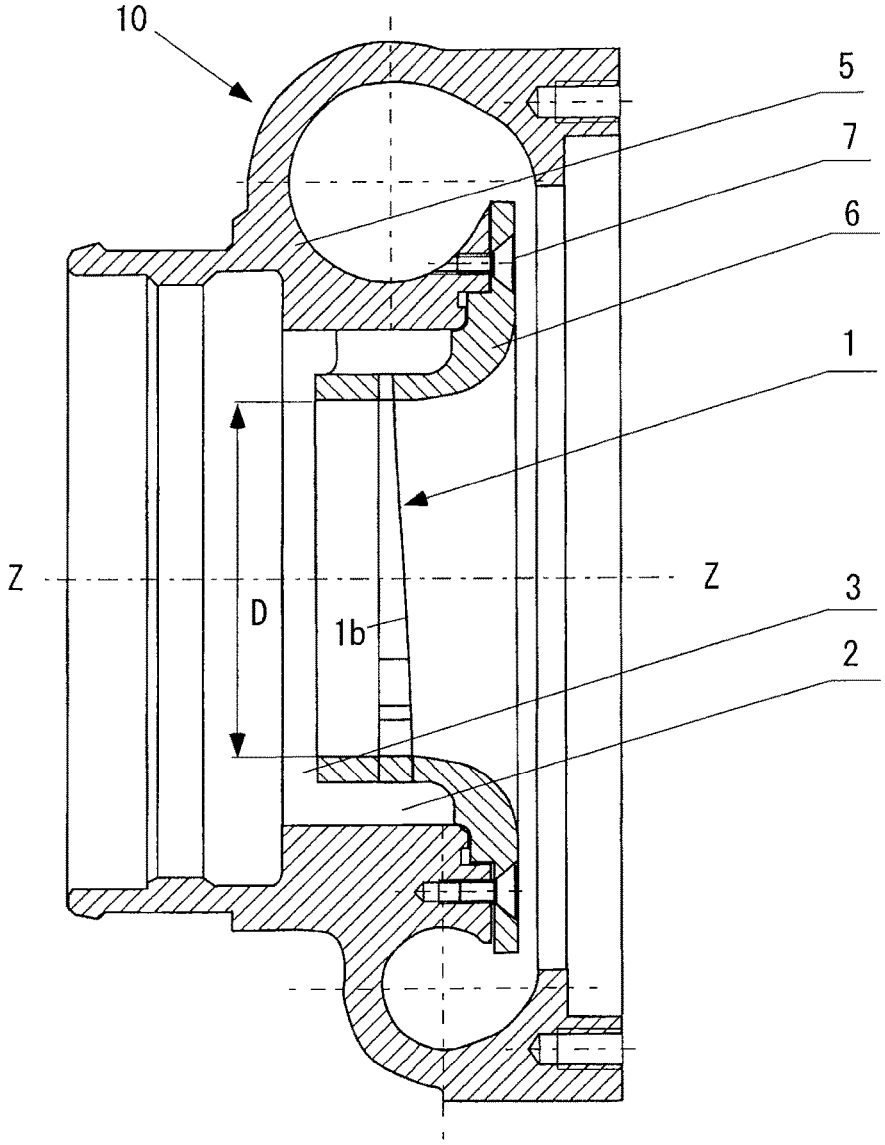
FIG. 10 is a schematic view of a casing of a compressor.
Figure 11:
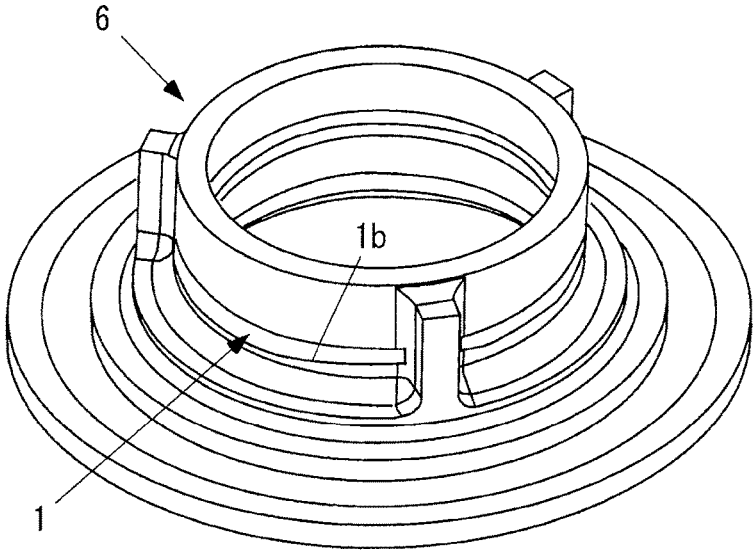
FIG. 11 is a schematic view of the configuration of a core of the casing.
Figure 12:
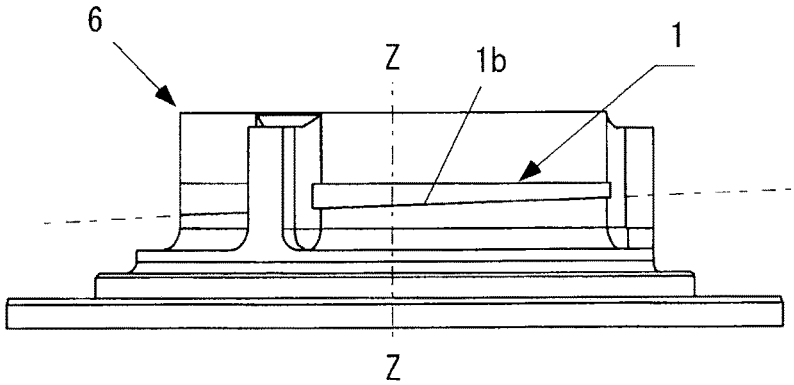
FIG. 12 is a schematic view of a suction ring groove in the core.

FIG. 10 to FIG. 12 schematically illustrate Embodiment 2 of the present invention, where FIG. 10 is a schematic view of a casing 10 of a compressor, FIG. 11 is a schematic view of the configuration of a core 6 of the casing 10, and FIG. 12 is a schematic view of a suction ring groove 1 in the core 6.

FIG. 2A and FIG. 2B are common to Embodiment 1.

As illustrated in FIG. 1, the centrifugal compressor of the present invention includes an asymmetric self-recirculating casing treatment that includes, on an inner face of a casing, a suction ring groove 1, a ring guide channel 2 and a back-flow ring groove 3, thus forming a self-recirculating channel.

In the centrifugal compressor of Embodiment 2, as illustrated in FIG. 10, a casing 10 includes a shell 5 and the core 6, where the suction ring groove 1 is provided on a wall face of the core 6, and the inner wall face of the shell 5 and the outer wall face of the core 6 define the ring guide channel 2 and the back-flow ring groove 3.

In the asymmetric self-recirculating casing treatment of Embodiment 2, the width $b_r$ of the suction ring groove 1 is distributed in a sinusoidal shape in the circumferential direction.

Further as illustrated in FIG. 10, in Embodiment 2, the width $b_r$ of the suction ring groove 1 is represented by Expression (2):

$$b_r = A \cdot \sin(\alpha + \theta_0) + A_0 \quad (2)$$

Further, a ratio between an average $A_0$ of the width $b_r$ of the suction ring groove 1 and an impeller diameter D is in the range of $0.01 \leq |A_0/D| < 0.1$, and a ratio between amplitude A of the distribution of the width $b_r$ and the average $A_0$ of the width ID, of the suction ring groove 1 is in the range of $0.1 < |A/A_0| < 0.35$.

In FIG. 12, geometric proof makes it clear that a downstream end face 1*b* of the suction ring groove 1 following the sinusoidal distribution as designed is included on a plane of a circumferential cylindrical column face of the core 6, which is illustrated with alternate long and short dash lines in FIG. 12.

This characteristic facilitates the processing and adjustment of the suction ring groove 1 designed. That is, the amplitude A of the width $b_r$ distribution can be changed by changing the gradient of a line around the rotation axis. Further, vertically parallel movement of the line can change the ratio between the average $A_0$ of the width $b_r$ of the suction ring groove 1 and the impeller diameter D and the ratio between amplitude A of the distribution of the width $b_r$ and the average $A_0$ of the width $b_r$ of the suction ring groove 1.

In FIG. 2A, FIG. 2B, FIG. 10 and FIG. 11, the shell 5 of the casing 10 is fixed, and the core 6 is rotated around the rotation axis center Z-Z of the impeller 13 (see FIG. 1) so as to change the opposed position of these members during assembly, whereby the sinusoidal distribution of the width $b_r$ of the suction ring groove 1 in the circumferential direction corresponding to different initial phase angles $\theta_0$ can be obtained.

That is, the shell 5 and the core 6 of the casing 10 are jointed by screws 7. At the shell 5 of the casing 10 are uniformly disposed n pieces (in this example, four) of screw holes in the circumferential direction, so that the distribution curves corresponding to different n pieces of initial phase angles $\theta_0$ are obtained. Performance test of the compressor is performed, whereby an optimum initial phase angle $\theta_0$ may be decided.

FIG. 6, referred to common to Embodiment 1, schematically illustrates a position of an initial phase angle $\theta_0$ in one example.

Figure 13:
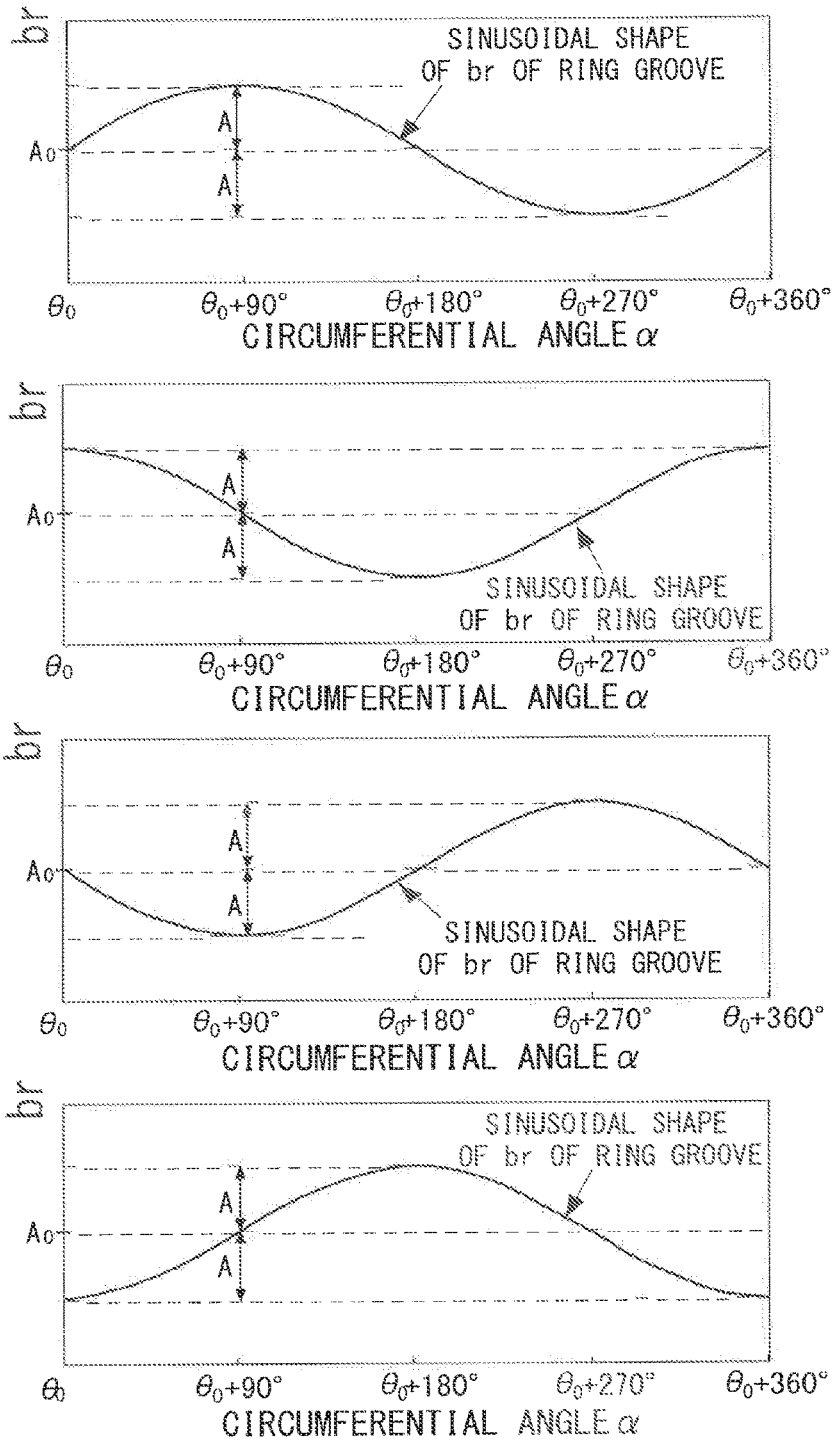
FIG. 13 schematically illustrates the distribution of the widths $b_r$ of the suction ring groove corresponding to different initial phase angles $\theta_0$.

For instance, since the four screw holes in total are provided at the shell 5 of the casing in FIG. 2A and FIG. 2B, different four types of sinusoidal distributions of the width $b_r$ of the suction ring groove 1 in the circumferential direction are obtained as illustrated in FIG. 13.

FIG. 13 schematically illustrates the distribution of the widths $b_r$ of the suction ring groove 1 corresponding to different initial phase angles $\theta_0$.

In FIG. 13, solid lines represent a sinusoidal distribution of the widths $b_r$ of the suction ring groove 1 in the circumferential direction, which can be represented variously by differently selecting the initial phase angle $\theta_0$ in the circumferential direction. Among them, $\theta_0$ represents an initial phase angle, and the casing 10 is the full circle of $0° \leq \theta_0 \leq 360°$. In the drawing, the circumferential angle $\alpha$ of the casing has a definition range of $\theta_0 \leq \alpha \leq \theta_{0+}360°$.

In the operation of the centrifugal compressor of the present invention, at a low flow-rate mode, the gas in the channel of the self-recirculating casing treatment flows into through the suction ring groove 1 and flows outside via the ring guide channel 2 and the back-flow ring groove 3.

More specifically, the centrifugal compressor operates based on the principle that the suction ring groove 1 of the self-recirculating casing treatment sucks the gas at an impeller blade tip area, and the gas flows through the ring guide channel 2 and the back-flow ring groove 3 discharges the gas.

As the back-flow ring groove 3 discharges the gas, (1) the gas suction effect of the impeller blade tip area at the groove width $b_r$ of the suction ring groove 1 causes leakage vortex at a clearance of the impeller blade tip to be sucked to the suction ring groove 1, thus interrupting a leakage flowing channel, (2) a back-flow is discharged to the compressor inlet, and the communication of the flow in the back-flow ring groove 3 realizes the uniform flow at the compressor inlet and removes shock waves in the channel, and (3) while the back-flow increases the inlet flow rate and decreases a positive angle of attack at the impeller blade inlet, the suction effect by the suction ring groove 1 decreases the back pressure of the compressor outlet and decreases the adverse pressure gradient, thus effectively suppressing the separation of boundary layers on the impeller blade surface.

For a better back-flow effect at a corresponding groove position in the circumferential direction, the groove width $b_r$ of the suction ring groove 1 is distributed in a sinusoidal shape in the circumferential direction, whereby the effect of the back-flow can be more effectively used to extend a stable operating range of the compressor.

At an operational mode close to a blockage, the gas in the channel of the self-recirculating casing treatment flows through the back-flow ring groove 3 and the ring guide channel 2 and is discharged from the suction ring groove 1. The back-flow ring groove 3 enables communication of the flow at the inlet in the circumferential direction to increase the uniformity of the flow at the compressor inlet and weaken shock waves at the inlet, and the discharged flow of the suction ring groove 1 strengthens the circulation ability, thus extending blockage boundary. However, because of the shortage of suction power at an operational mode close to a blockage, expansion for the blockage boundary of the casing treatment is not so remarkable as the expansion for stall boundary.

Example 2

The following describes an example to extend a stable operation range by using an asymmetric self-recirculating casing treatment for a centrifugal compressor having a width $b_r$ of the suction ring groove 1 in a sinusoidal distribution in a centrifugal compressor of a certain size.

The width $b_r$ of the asymmetric casing treatment of the centrifugal compressor is distributed as $b_r=\sin(\alpha+180°)+4.5$. The initial phase angle $\theta_0$ is at the position of $\theta_0=180°$ in FIG. 6.

Figure 14A:
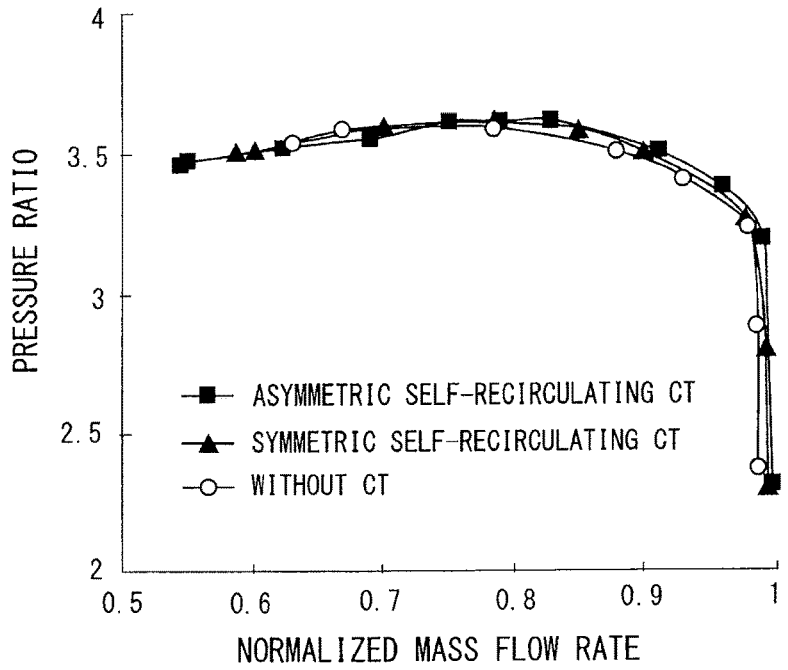
FIG. 14A illustrates a relationship between a normalized mass flow rate and a pressure ratio in Example 2.
Figure 14B:
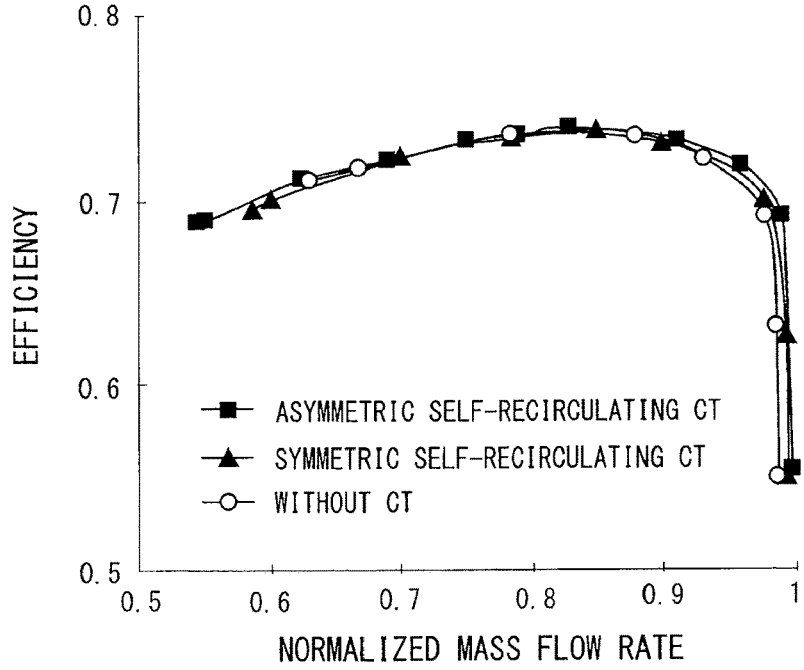
FIG. 14B illustrates a relationship between a normalized mass flow rate and efficiency in Example 2.

FIG. 14A and FIG. 14B illustrate a comparison of compressor performance among an asymmetric self-recirculating casing treatment having a groove width in a sinusoidal distribution ("asymmetric self-recirculating CT"), a symmetric self-recirculating casing treatment ("symmetric self-recirculating CT") and without casing treatment ("without CT").

FIG. 14A illustrates a relationship between a normalized mass flow rate and a pressure ratio in Example 2. FIG. 14B illustrates a relationship between a normalized mass flow rate and efficiency in Example 2.

The performance comparison between FIG. 14A and FIG. 14B shows that the asymmetric self-recirculating casing treatment having a groove width in a sinusoidal distribution ("asymmetric self-recirculating CT") of the present invention can extend a stable operating range of the compressor to a low flow-rate side while basically keeping the efficiency as compared with the cases of without a casing treatment ("without CT") and the symmetric self-recirculating casing treatment ("symmetric self-recirculating CT").

As described above, Examples 1 and 2 show that as compared with conventional techniques, the present invention uses an asymmetric self-recirculating casing treatment having an axial distance $S_r$ or a width $b_r$ of the suction ring groove 1 in a sinusoidal distribution, thereby enabling great expansion of a stable operating range of the centrifugal compressor while basically keeping the efficiency as compared with a symmetric self-recirculating casing treatment.

The present invention is not limited to the aforementioned embodiments, and can be modified variously in the range without departing from the scope of the present invention.

DESCRIPTION OF REFERENCE NUMERALS

1: suction ring groove
1*a*: upstream end face, 1*b*: downstream end face
2: ring guide channel
3: back-flow ring groove, 4: impeller full blade leading edge
5: shell, 6: core, 7: screw
10: casing, 11: impeller full blade
12: impeller splitter blade, 13: impeller

The invention claimed is:

1. A centrifugal compressor comprising an asymmetric self-recirculating casing treatment that includes, on an inner face of a casing, a suction ring groove, a ring guide channel and a back-flow ring groove to form a self-recirculating channel, wherein an axial distance $S_r$ from an upstream end face of the suction ring groove to an impeller full blade leading edge or a width $b_r$ of the suction ring groove is distributed in a sinusoidal shape represented by $A\cdot\sin(\alpha+\theta_0)+A_0$ in a circumferential direction, an initial phase angle $\theta_0$ is in a range of $0°\leq\theta_0\leq360°$, a circumferential angle $\alpha$ of the casing has a definition range of $\theta_0\leq\alpha\leq\theta_0+360°$, A denotes amplitude of distribution of the axial distance $S_r$ or the width $b_r$, and $A_0$ denotes an average of the axial distance $S_r$ or the width $b_r$, wherein, in the sinusoidal distribution, as a position of the suction ring groove is shifted in the circumferential direction, the axial distance $S_r$ or the width $b_r$ of the suction ring groove gradually increases over a first circumferential range, and then gradually decreases over a second circumferential range so that the position of the suction ring groove makes one complete circle, and the first and second ranges make one complete circle.

2. The centrifugal compressor comprising an asymmetric self-recirculating casing treatment according to claim 1, wherein $A_0$ denotes an average of the axial distance $S_r$, a ratio between the average $A_0$ of the axial distance $S_r$ of the suction ring groove and an impeller diameter D is in a range of $0.05\leq|A_0/D|<0.2$, A denotes amplitude of distribution of the axial distance $S_r$, and a ratio between the amplitude A of the distribution of the axial distance $S_r$ and the average $A_0$ is in a range of $0.1|A/A_0|<0.35$.

3. The centrifugal compressor according to claim 2, wherein the casing includes a shell and a core, and the suction ring groove is provided on a wall face of the core, and an inner wall face of the shell and an outer wall face of the core define the ring guide channel and the back-flow ring groove.

4. The centrifugal compressor comprising an asymmetric self-recirculating casing treatment according to claim 1, wherein $A_0$ denotes an average of the width $b_r$, a ratio between the average $A_0$ of the width $b_r$ of the suction ring groove and an impeller diameter D is in a range of $0.01\leq|A_0/D|<0.1$, A denotes amplitude of the width $b_r$, and a ratio between the amplitude A of the distribution of the width $b_r$ and the average $A_0$ is in a range of $0.1<|A/A_0|<0.35$.

5. The centrifugal compressor according to claim 4, wherein the casing includes a shell and a core, and the suction ring groove is provided on a wall face of the core, and an inner wall face of the shell and an outer wall face of the core define the ring guide channel and the back-flow ring groove.

6. The centrifugal compressor according to claim 1, wherein the casing includes a shell and a core, and the suction ring groove is provided on a wall face of the core, and an inner wall face of the shell and an outer wall face of the core define the ring guide channel and the back-flow ring groove.

7. The centrifugal compressor according to claim 1, wherein the casing includes a shell and a core, the suction ring groove is provided on a wall face of the core, and the initial phase angle $\theta_0$ defines a rotational position of the core relative to the shell around a rotation axis of an impeller of the centrifugal compressor.

8. A method of manufacturing a casing of a centrifugal compressor, the method comprising the steps of:

(a) providing a casing;

(b) forming, on an inner face of the casing, an asymmetric self-recirculating casing treatment that includes a suction ring groove, a ring guide channel, and a back-flow ring groove, wherein the asymmetric self-recirculating casing treatment is formed such that an axial distance $S_r$ from an upstream end face of the suction ring groove to an impeller full blade leading edge of the centrifugal compressor or a width $b_r$ of the suction ring groove is distributed in a sinusoidal shape with respect to a position in a circumferential direction around a rotation axis of the centrifugal compressor, wherein, in the sinusoidal distribution, as a position of the suction ring groove is shifted in the circumferential direction, the axial distance $S_r$ or the width $b_r$ of the suction ring groove gradually increases over a first circumferential range, and then gradually decreases over a second circumferential range, so that the position of the suction ring groove makes one complete circle, and the first range and the second range make one complete circle.

9. The method according to claim 8, wherein the sinusoidal shape is represented by $A \cdot \sin(\alpha+\theta_0)+A_0$ in a circumferential direction, an initial phase angle $\theta_0$ is in a range of $0° \leq \theta_0 \leq 360°$, a circumferential angle $\alpha$ of the casing has a definition range of $\theta_0 \leq \alpha \leq \theta_0+360°$, A denotes amplitude of distribution of the axial distance $S_r$ or the width $b_r$, $A_0$ denotes an average of the axial distance $S_r$ or the width $b_r$, the casing includes a shell and a core, the suction ring groove is provided on a wall face of the core, and the initial phase angle $\theta_0$ defines a rotational position of the core relative to the shell around a rotation axis of an impeller of the centrifugal compressor.

* * * * *